US005204726A

United States Patent [19]

Choi

[11] Patent Number: 5,204,726

[45] Date of Patent: Apr. 20, 1993

[54] COPYING PAPER FEED SENSING DEVICE FOR A COPYING APPARATUS

[76] Inventor: Hoon B. Choi, 29-28, Shinsa-dong, Unpyung-ku, Seoul, Rep. of Korea

[21] Appl. No.: 787,093

[22] Filed: Nov. 4, 1991

[30] Foreign Application Priority Data

Nov. 8, 1990 [KR] Rep. of Korea ..... 17077/1990

[51] Int. Cl.[5] ..... G03G 21/00

[52] U.S. Cl. ..... 355/316; 271/258; 355/208

[58] Field of Search ..... 355/208, 209, 308, 316, 355/317, 203, 206; 271/152, 154, 256, 258, 259, 265; 377/3, 17; 318/602, 603, 640

[56] References Cited

U.S. PATENT DOCUMENTS 4,684,235 8/1987 Kohmoto et al. ..... 355/316
4,860,051 8/1989 Taniguchi et al. ..... 355/204 X
4,963,941 10/1990 Negishi et al. ..... 355/282

*Primary Examiner*—A. T. Grimley
*Assistant Examiner*—Christopher Horgan
*Attorney, Agent, or Firm*—Fish & Richardson

[57] ABSTRACT

A device for sensing feeding of copying papers, which may promptly detect paper jamming and misfeeding occurring at a paper feed route of a copying apparatus, such as a laser printer or a copier, thereby preventing pollution by toner or damage of the apparatus. To this end, the device comprises a ratatable actuator of a circular disk shape having a plurality of slits, a first sensor disposed outwardly of the actuator to sense a paper feed condition, and a second sensor disposed outwardly of the actuator to sense the presence and absence of the paper, whereby both the actual feed state and feed distance of the paper may be promptly detected during feeding of the papers.

2 Claims, 3 Drawing Sheets

COPYING PAPER FEED SENSING DEVICE FOR A COPYING APPARATUS

BACKGROUND OF THE INVENTION

1. Field of the Invention

This invention relates to a device for sensing feeding of copying papers, which is able to promptly detect jamming and misfeeding of the papers being fed along a copying paper feed route in a copying apparatus, such as a copier or a printer utilizing an electrophotographic system.

2. Description of the Prior Art

Generally, a copying paper feed route of a conventional copying apparatus comprises, as shown in FIG. 1 of the accompanying drawings, a pair of feed rollers 2 through which papers contained in a paper supply tray 1 are fed one by one toward a photosensitive drum 3 where copying is performed thereon, and a pair of discharge rollers 4 for discharging the paper undergone copying operation at the photosensitive drum 3 to paper collection tray 5.

In order to sense possible jamming or misfeeding of the copying paper being fed along the feed route, the prior copying apparatus is provided with sensing devices indicated by "S" in FIG. 1, which are disposed one at each of positions between the paper supply tray 1 and the feed rollers 2, and between the discharge rollers 4 and the paper collection tray 5.

Various sensing devices which are somewhat different in construction from each other depending upon systems have been employed, a typical example of which comprises, as shown in FIG. 2, a photosensor 6 having an ON-OFF function and fixedly secured at one side to a support plate 7, and a generally L-shaped actuate 8 acting to autuate the photosensor 6 and pivotally disposed above the copying paper feed route to detect a paper feeding condition.

With the device thus constructed, when there is no paper (being fed in the direction of "A" in FIG. 2) on the paper feed path, the actuator 8 falls by own gravity into an opening formed in the feed path, thereby getting out of intervention in a slot portion 6*a* of the photosensor 6, as shown in FIG. 2.

As a result, the photosensor 6 keeps an ON condition indicating the absence of the paper. In this state, when the paper is fed, the actuator 8 held in the descended position is rotated in the direction of the arrow in FIG. 2 by the paper being fed, to be inserted into the slot portion 6*a* of the photosensor 6, thereby changing the ON condition of the photosensor into the OFF condition which indicates the feeding of the paper.

As described above, the prior art device has the construction in which the photosensor switched on and off by the actuator pivotally movable upward and downward depending upon the feeding condition of the paper simply senses only such a feeding condition of the paper, that is, whether or not the paper passes by the actuator. Therefore, the sensing of abnormality such as a paper jamming phenomenon which may occur at the paper feed path extending from the feed rollers through the photosensitive drum to the discharge rollers is carried out by a pair of the photosensors each disposed in the vicinity of each of the paper supply and collection trays, as shown in FIG. 1, to check paper traveling time at a section between them, so that when discharging of the fed paper is delayed over any given time, the occurrence of the paper jamming phenomenon is detected.

However, according to the prior art, the copying apparatus continues its normal operation for any period of time for sensing a jamming phenomenon by the photosensors and then stopping the operation of the apparatus. Therefore, in case that the jamming phenomenon occurs between the feed rollers and the photosensitive drum, the copying apparatus continues its operation without the paper fed to the photosensitive drum, so that toner may pollute a photosensitive portion and the jammed paper may impart compulsive force to the apparatus. Therefore, copying performance may be lowered and a life of the apparatus may be decreased.

SUMMARY OF THE INVENTION

In view of the foregoing drawbacks of the prior art device, it is an object of the present invention to provide a copying paper feed sensing device which is able to quickly detect a jamming phenomenon occurring during feeding of papers, thereby stopping operation of a copying apparatus.

To achieve the above object, there is provided according to the present invention a device for sensing feeding of copying papers in a copying apparatus, comprising support bars provided on a paper feed path to be pivotable about a pivot shaft, an actuator of a circular disk shape formed with a plurality of slits and rotatably disposed through a support shaft at leading ends and disposed outwardly of the actuator in such a manner that it describes a trace on the slits during rotation of the actuator, and a second sensor functioning to sense the presence and absence of the paper on the paper feed path and disposed outwardly of the actuator in such a manner that it describes a trace on a solid portion of the actuator during rotation of the actuator, whereby both the normal feed state and feed distance of the paper may be promptly detected through the actuator rotating depending upon a traveling condition of the fed paper.

BRIEF DESCRIPTION OF THE DRAWINGS

The invention will now be described further, by way of example, with reference to the accompanying drawings, in which.

DESCRIPTION OF THE PREFERRED EMBODIMENT

Figure 1:
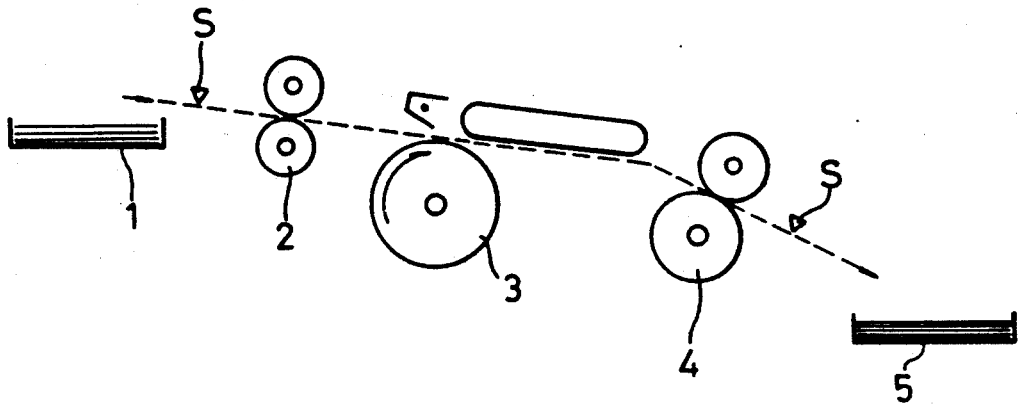
FIG. 1 PRIOR ART
FIG. 1 is a schematic view showing a paper feeding route of a conventional copying apparatus.
Figure 2:
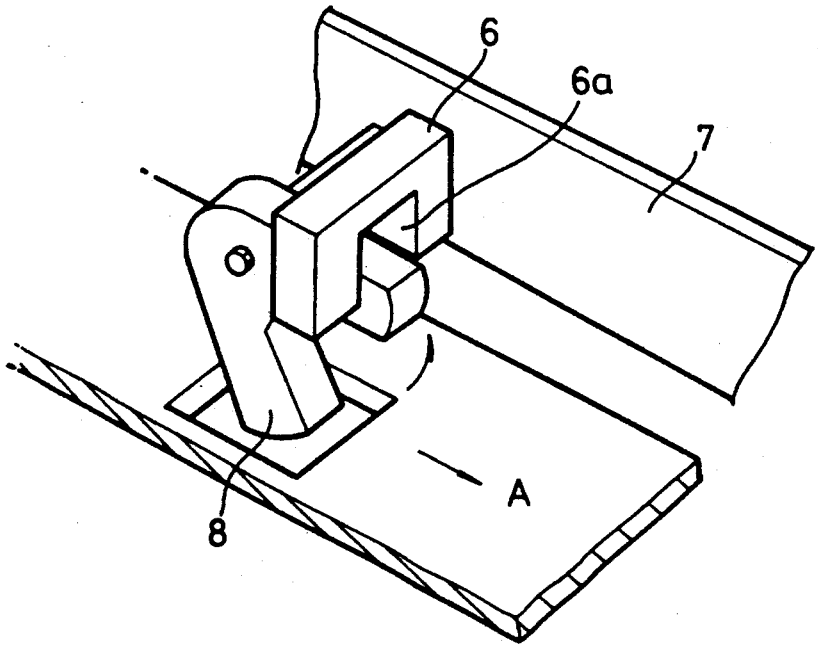
FIG. 2 PRIOR ART
FIG. 2 is a perspective view of a sensing device of the prior art.
Figure 3:
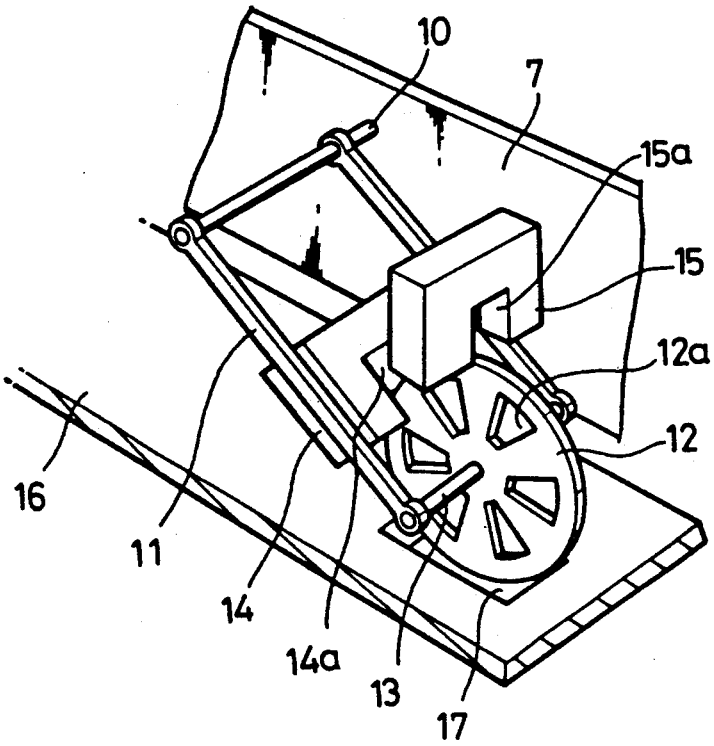
FIG. 3 is a perspective view of a sensing device according to the present invention.

FIG. 3 illustrates a perspective view of a copying paper feed sensing device according to the present invention, which comprises a pair of parallel, spaced-apart support bars 11 each pivotally connected at one end to a pivot shaft 10 which is in turn fixed to a vertical support plate 7, and an actuator 12 of a circular disk shape having a plurality of circumferentially spaced-apart slits 12*a* and rotatably disposed through a support shaft 13 at the other end of each of the support bars 11.

In addition, a first sensor 14 of a general U-shape having at one side a slit portion 14*a* into which the actuator 12 is partially inserted is positioned between the parallel support bars 11 and fixedly secured to the support bars for movement with them. A second sensor 15 having the same U-shape as the first sensor 14 and a slit portion 15*a* is fixedly secured to the support plate 7 at a position above the actuator 12 with the slit portion 15*a* facing to the actuator, so that when the actuator is elevated, a portion of the actuator is located in the slit portion 15*a*.

Furthermore, a horizontal guide plate 16 for guiding the feeding of copying paper (not shown) has a recess 17 formed therein at a position directly below the actuator 12, so that when the paper is not fed, the actuator 12 is partially located by its own gravity in the recess 17, while during the feeding of the paper the actuator is elevated by the surface of the paper.

Figure 4:
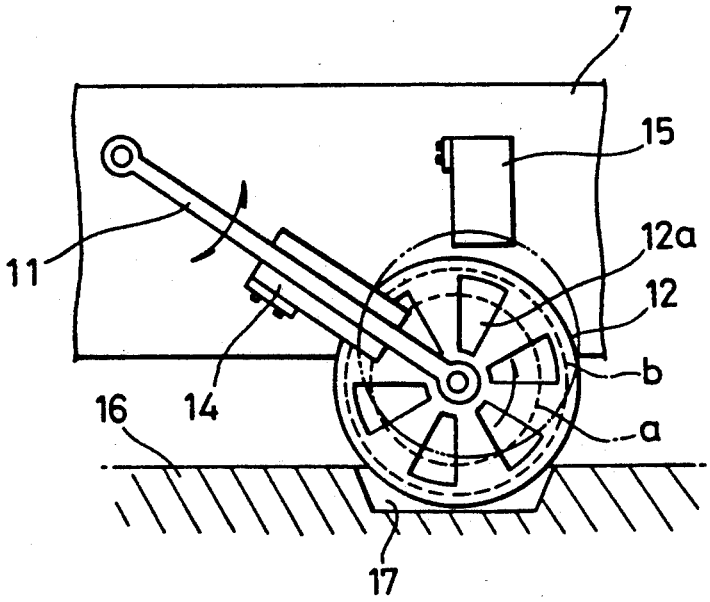
FIG. 4 is a side view of the device in FIG. 3.

Referring to FIG. 4 showing a side view of the devide of the present invention in FIG. 3, the first sensor 14 fixed to the support bars 11 is arranged such that a sensing position of the slit portion 14*a* describes the trace "a" on the slits 12*a* of the actuator 12 during rotation of the plate 7 is arranged such that when the actuator is elevated by the surface of the traveling paper to a position as indicated by the two-dot-and-dash lines, a sensing position of the slit portion 15*a* describes the trace "b" on a solid portion of the actuator.

The process of sensing the feeding condition of the paper by the sensors thus arranged will be described below.

Figure 5:
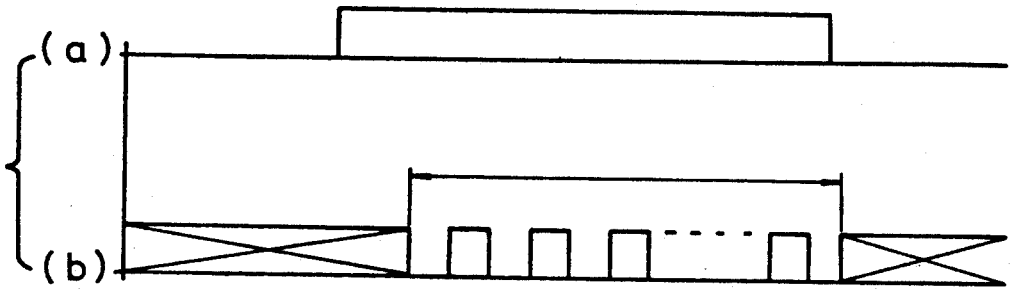
FIG. 5 is a waveform chart of outputs of the sensor shown in FIG. 4.

First, in the state as shown by the solid line in FIGS. 3 and 4, when the fed copying paper travels along the guide plate 16 to the actuator 12, the actuator held in the lowered position is raised by the surface of the paper along with the first sensor 14 through the support bars 11 pivotable about the pivot shaft 10, and then partially enters the slit portion 15*a* of the second sensor 15 positioned above it. As a result, the second sensor is actuated by the raised actuator to generate a high output as shown in FIG. 5(*a*), thereby indicating the presence of the paper on the feed path.

Then, if the paper is continuously fed toward the photosensitive drum by the feed rollers, the actuator 12 is rotated by the paper passing through between the actuator and the guide plate 16, thereby actuating the first sensor 14. As a result, the first sensor generates constant pulses as shown in FIG. 5(*b*), which result from repeated, alternate ON and OFF of the output of the first sensor by means of the slits 12*a* of the actuator and depend upon the speed of feed of the paper and the rotation of the actuator. At this time, the frequency of the output generated from the first sensor 14 is expressed by the following equation:

$$f = \upsilon \times \pi R \times n$$

where $\upsilon$ is the speed of feed of the paper, R is the diameter of the actuator 12, and n is the number of the slits 12*a* of the actuator.

Figure 6:
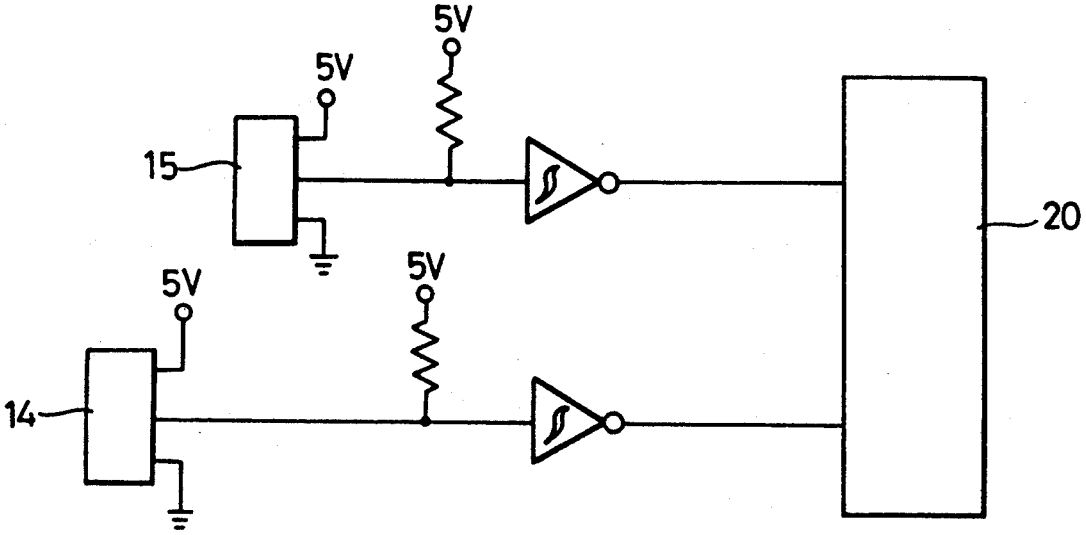
FIG. 6 is a circuit diagram of the sensor according to the present invention.

In the circuit diagram shown in FIG. 6, when the feed of the paper is detected by the second sensor 15, a microprocessor 20 continues monitoring of the ON-OFF cycle of the output of the first sensor 14. At this time, if abnormality of the ON-OFF cycle due to the jamming phenomenon is sensed, the microprocessor functions to promptly stop the copying operation and signal to the user the occurrence of the paper jamming. Here, the microprocessor 20 may discriminate the paper feeding distance by counting the pulses. Further, the first and second sensors 14 and 15 may be of one of various types, but in this embodiment are photosensors.

From the foregoing detailed description, it can be seen that the present invention provides advantages over the prior art since the device is able to sense both the actual feed state and feed distance of the copying paper during feeding of the papers, thereby promptly detecting the misfeeding and jamming of the paper and stopping the operation of the copying apparatus, preventing pollution of the photosensitive portion by toner and preventing application of compulsive force to the apparatus, which may occur in the prior art due to delay of the sensing time. This results in the enhanced quality and long service life of the apparatus.

Having described but a single embodiment of this invention, it will be apparent that many changes and modifications can be made therein without departing from the spirit and scope of the invention as defined in the appended claims.

What is claimed is:

1. A device for sensing feeding of copying papers in a copying apparatus, comprising:

support bars provided on a paper feed path to be pivotable about a pivot shaft;

an actuator of a circular disk shape formed with a plurality of slits and rotatably disposed through a support shaft at leading ends of said support bars;

a first sensor functioning to sense a paper jamming or misfeeding and disposed outwardly of said actuator in such a manner that it describes a trace on said slits during rotation of said actuator; and a second sensor functioning to sense the presence and absence of the paper on said paper feed path and disposed outwardly of said actuator in such a manner that it describes a trace on a solid portion of said actuator during rotation of said actuator.

2. A device for sensing feeding of copying papers in a copying apparatus as claimed in claim 1, in which each of said first and second sensors comprises a photosensor.

* * * * *